US012778289B2

(12) United States Patent
Chen et al.

(10) Patent No.: US 12,778,289 B2
(45) Date of Patent: Nov. 3, 2026

(54) FITTING ASSEMBLY AND FITTING DEVICE THEREOF

(71) Applicants: King Slide Works Co., Ltd., Kaohsiung City (TW); King Slide Technology Co., Ltd., Kaohsiung City (TW)

(72) Inventors: Ken-Ching Chen, Kaohsiung City (TW); Shun-Ho Yang, Kaohsiung City (TW); Tzu-Cheng Weng, Kaohsiung City (TW); Chun-Chiang Wang, Kaohsiung City (TW)

(73) Assignees: King Slide Works Co., Ltd., Kaohsiung City (TW); King Slide Technology Co., Ltd., Kaohsiung City (TW)

( * ) Notice: Subject to any disclaimer, the term of this patent is extended or adjusted under 35 U.S.C. 154(b) by 217 days.

(21) Appl. No.: 18/736,123

(22) Filed: Jun. 6, 2024

(65) Prior Publication Data

US 2025/0160515 A1 May 22, 2025

(30) Foreign Application Priority Data

Nov. 21, 2023 (TW) ..... 112145265

(51) Int. Cl.
*A47B 88/40* (2017.01)
*A47B 88/407* (2017.01)
*A47B 88/43* (2017.01)

(52) U.S. Cl.
CPC ..... *A47B 88/407* (2017.01); *A47B 88/43* (2017.01)

(58) Field of Classification Search
CPC ..... A47B 88/407; A47B 88/43; H05K 7/18; H05K 7/1489; H05K 7/1488
See application file for complete search history.

(56) References Cited

U.S. PATENT DOCUMENTS 5,833,337 A * 11/1998 Kofstad ..... H05K 7/1489 211/175
6,431,668 B1 * 8/2002 Reddicliffe ..... A47B 88/43 312/334.1
6,615,992 B1 * 9/2003 Lauchner ..... H05K 7/1489 211/175
6,866,154 B2 * 3/2005 Hartman ..... A47B 88/43 211/26
6,938,967 B2 * 9/2005 Dubon ..... H05K 7/1489 312/334.44

(Continued)

FOREIGN PATENT DOCUMENTS

EP 1403970 B1 7/2006
EP 3750446 A1 12/2020

(Continued)

*Primary Examiner* — Ko H Chan
(74) *Attorney, Agent, or Firm* — Best & Flanagan LLP

(57) ABSTRACT

A fitting device of a fitting assembly is configured to be mounted to a rack. The fitting device includes a first end part, a second end part and a main body part connected between the first end part and the second end part. The fitting device further includes a locking member and an operating member. The locking member is arranged on the main body part and configured to lock the fitting device to the rack. The operating member is configured to drive the locking member to move.

12 Claims, 14 Drawing Sheets

(56) References Cited

U.S. PATENT DOCUMENTS

| | | | | |
|---|---|---|---|---|
| 6,948,691 | B2 * | 9/2005 | Brock | H05K 7/1489 312/334.44 |
| 6,962,397 | B2 * | 11/2005 | Dobler | A47B 88/463 312/333 |
| 7,137,512 | B2 * | 11/2006 | Nguyen | H05K 7/183 211/183 |
| 8,851,300 | B2 * | 10/2014 | Dykstra | A47B 46/00 211/187 |
| 9,629,276 | B2 * | 4/2017 | Sampath | H05K 7/1489 |
| 10,314,394 | B2 * | 6/2019 | Chen | H05K 7/183 |
| 10,806,255 | B1 | 10/2020 | Chen et al. | |
| 11,213,123 | B2 * | 1/2022 | Chen | A47B 88/493 |
| 11,647,836 | B2 | 5/2023 | Chen et al. | |
| 2006/0000961 | A1 * | 1/2006 | Wei-Chieh | G06F 1/187 248/223.41 |
| 2007/0039913 | A1 * | 2/2007 | Chen | A47B 88/43 211/192 |
| 2012/0288221 | A1 * | 11/2012 | Jahrling | A47B 88/47 384/20 |
| 2018/0084907 | A1 * | 3/2018 | Chen | A47B 57/34 |
| 2022/0202181 | A1 | 6/2022 | Chen et al. | |

FOREIGN PATENT DOCUMENTS

| | | | |
|---|---|---|---|
| EP | 3975674 | A1 | 3/2022 |
| JP | 2022-053472 | A | 4/2022 |

* cited by examiner

FITTING ASSEMBLY AND FITTING DEVICE THEREOF

BACKGROUND OF THE INVENTION

1. Field of the Invention

The present invention relates to a fitting assembly, and more particularly, to a fitting assembly applicable to a rack or a cabinet.

2. Description of the Prior Art

U.S. Pat. No. 10,314,394B2 discloses a rack system comprising a rack, a first adapter mechanism and a second adapter mechanism. The rack has a first side and a second side. A first width is defined between the first side and the second side. The first adapter mechanism is detachably mounted to the first side of the rack. The second adapter mechanism is detachably mounted to the second side of the rack. A second width is defined between the first adapter mechanism and the second adapter mechanism, and the second width is smaller than the first width. The slide rail assemblies in the patent are configured to be mounted to the rack through the first adapter mechanism and the second adapter mechanism. In other words, the slide rail assemblies are mounted within a space having the second width smaller than the first width through the first adapter mechanism and the second adapter mechanism. A second side plate of an end part of the first adapter mechanism (or the second adapter mechanism) is configured to be engaged between two of a plurality of mounting features of the rack.

However, for different market requirements, it is important to develop various products.

SUMMARY OF THE INVENTION

The present invention provides a fitting assembly applicable to a rack.

According to an embodiment of the present invention, a fitting assembly is configured to be mounted to a rack comprising a first side frame and a second side frame. A first width is defined between the first side frame and the second side frame. The fitting assembly comprises a first fitting device and a second fitting device. The first fitting device is configured to be mounted to the first side frame of the rack. The second fitting device is configured to be mounted to the second side frame of the rack. A second width defined between the first fitting device and the second fitting device is smaller than the first width. The first fitting device and the second fitting device are configured to mount a first slide rail assembly and a second slide rail assembly to the first side frame and the second side frame respectively. The first fitting device comprises a first end part, a second end part and a main body part connected between the first end part and the second end part, and the main body part is arranged with an engaging structure configured to be engaged to the first side frame of the rack.

According to another embodiment of the present invention, a fitting device is configured to be mounted to a rack. The fitting device comprises a first end part, a second end part, a main body part connected between the first end part and the second end part, a locking member, a mounting feature and an operating member. The main body part is arranged with an engaging structure configured be engaged to the rack. The locking member is arranged on the main body part. The mounting feature is arranged on the locking member and configured to lock the engaging structure to the rack, in order to prevent the engaging structure from being disengaged from the rack. The operating member is configured to drive the locking member to move.

According to another embodiment of the present invention, a fitting device is configured to be mounted to a rack. The fitting device comprises a front end part, a rear end part, a main body part connected between the front end part and the rear end part, a locking member arranged on the main body part, a mounting feature arranged on the locking member and configured to lock the fitting device to the rack, and an operating member configured to drive the locking member to move, wherein the operating member comprises an operating part adjacent to one of the front end part and the rear end part.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
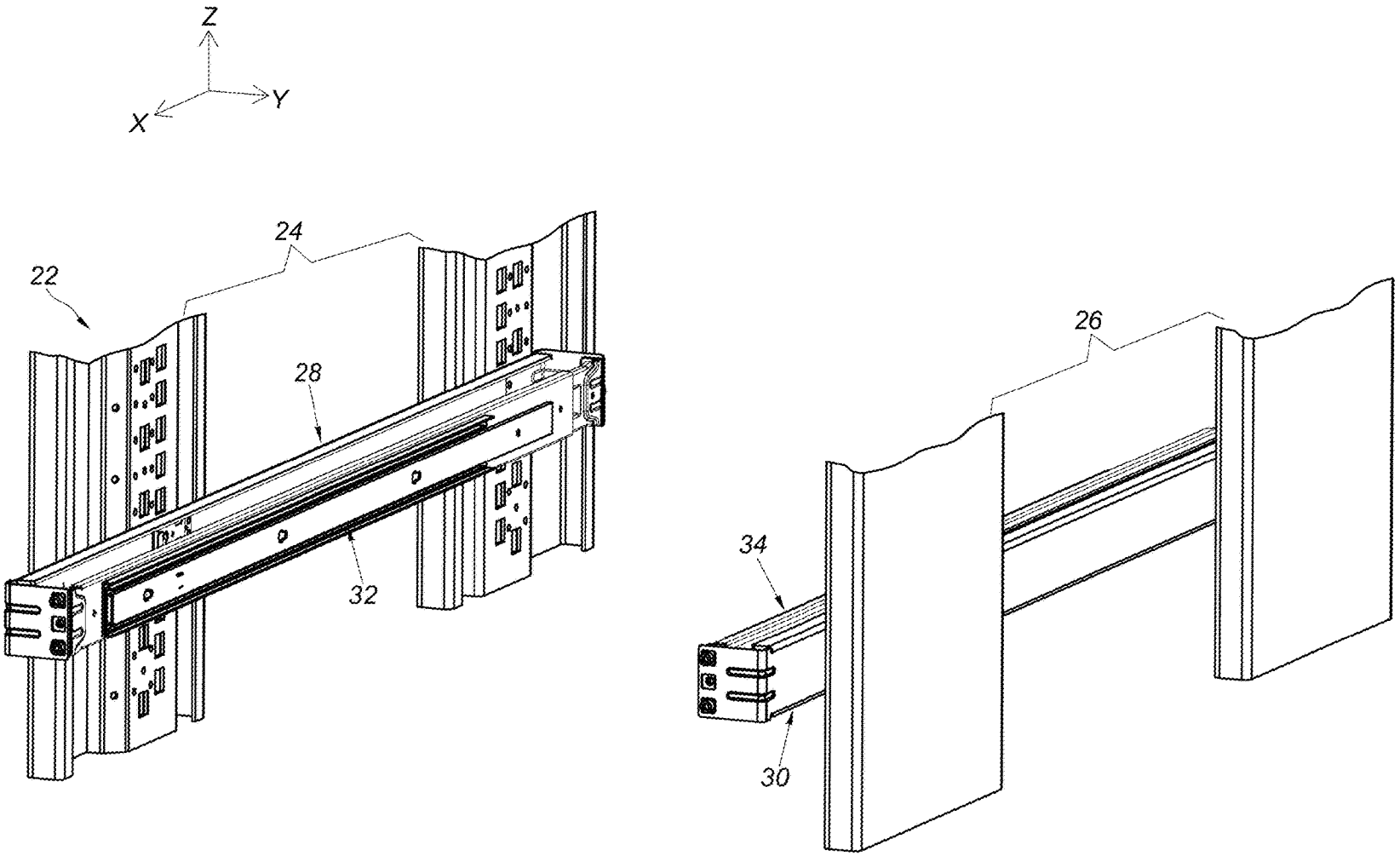
FIG. 1 is a diagram showing a fitting assembly applicable to a rack according to a first embodiment of the present invention.
Figure 2:
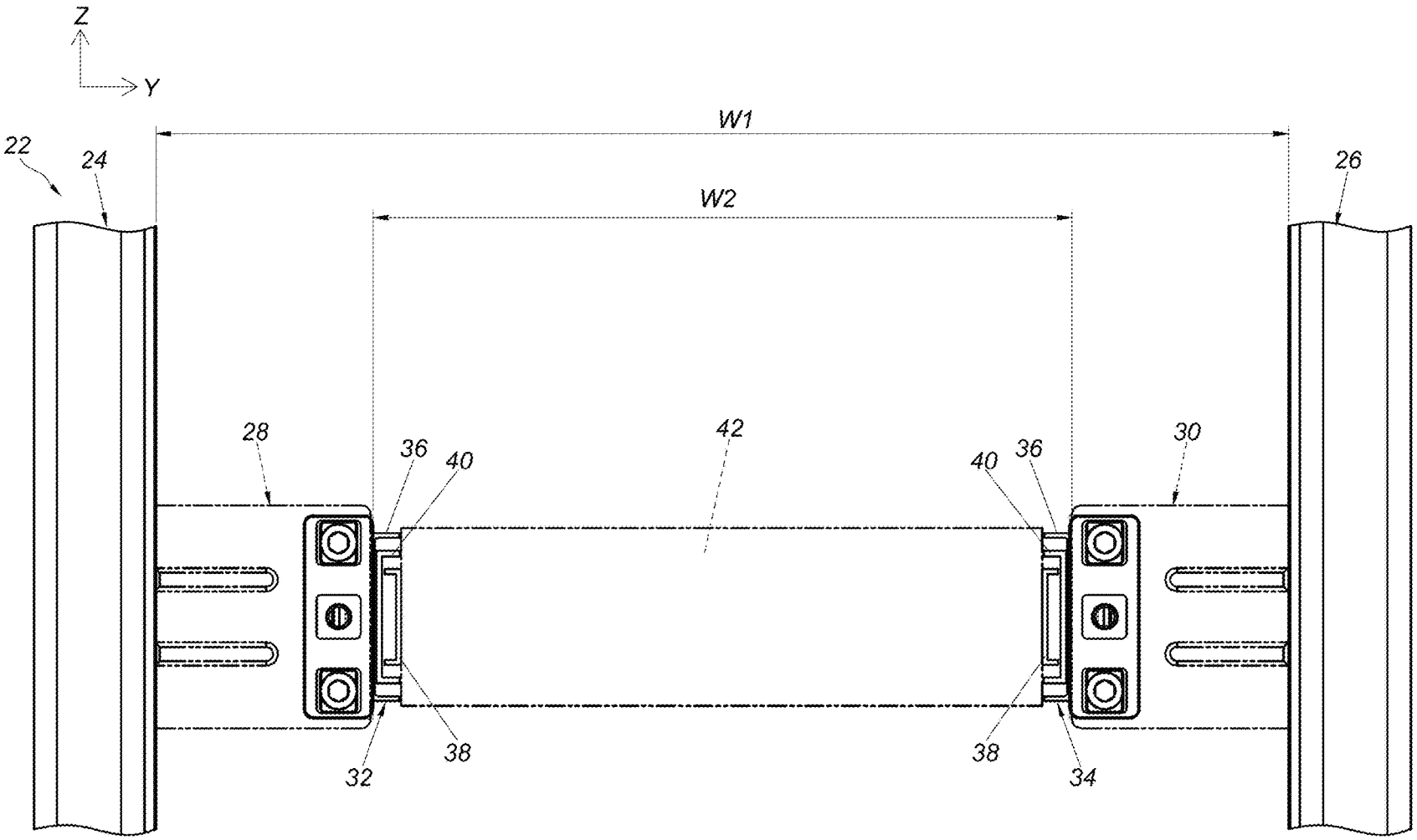
FIG. 2 is a diagram showing the fitting assembly applicable to the rack according to the first embodiment of the present invention.

As shown in FIG. 1 and FIG. 2, a fitting assembly is applicable to a rack 22 (or a cabinet) according to a first embodiment of the present invention. The rack 22 comprises a first side frame 24 and a second side frame 26, such as a left side frame and a right side frame. Structural configuration of the first side frame 24 is substantially identical to or symmetric to structural configuration of the second side frame 26, but the present invention is not limited thereto. A first width W1 is defined between the first side frame 24 and the second side frame 26 of the rack 22.

The fitting assembly comprises a first fitting device 28 and a second fitting device 30. Structural configuration of the first fitting device 28 is substantially identical to or symmetric to structural configuration of the second fitting device 30, but the present invention is not limited thereto. The first fitting device 28 is configured to be mounted to the first side frame 24 of the rack 22, and the second fitting device 30 is configured to be mounted to the second side frame 26 of the rack 22. The manner of mounting the first fitting device 28 to the first side frame 24 is substantially identical to the manner of mounting the second fitting device 30 to the second side frame 26. A second width W2 is defined between the first fitting device 28 and the second fitting device 30, and the second width W2 is smaller than the first width W1.

The first fitting device 28 and the second fitting device 30 are configured to mount a first slide rail assembly 32 and a second slide rail assembly 34 to the first side frame 24 and the second side frame 26 respectively. Structural configuration of the first slide rail assembly 32 is substantially identical to or symmetric to structural configuration of the second slide rail assembly 34. For example, each of the first slide rail assembly 32 and the second slide rail assembly 34 comprises a first rail 36 (outer rail), a second rail 38 (inner rail), and a third rail 40 (middle rail) movably mounted between the first rail 36 and the second rail 38. However, the number of slide rails is not limited in the present invention. Preferably, a carried object 42 (as shown in FIG. 2) is configured to be carried by the second rail 38 of the first slide rail assembly 32 and the second rail 38 of the second slide rail assembly 34, and a slide assisting device is arranged between each two slide rails (such as the first rail 36 and the third rail 40, or the third rail 40 and the second rail 38) to facilitate relative longitudinal movement between each two slide rails. In the figures, the X axis is a longitudinal direction (or a length direction of the slide rail), the Y axis is a transverse direction (or a lateral direction of the slide rail), and the Z axis is a vertical direction (or a height direction of the slide rail).

Figure 3:
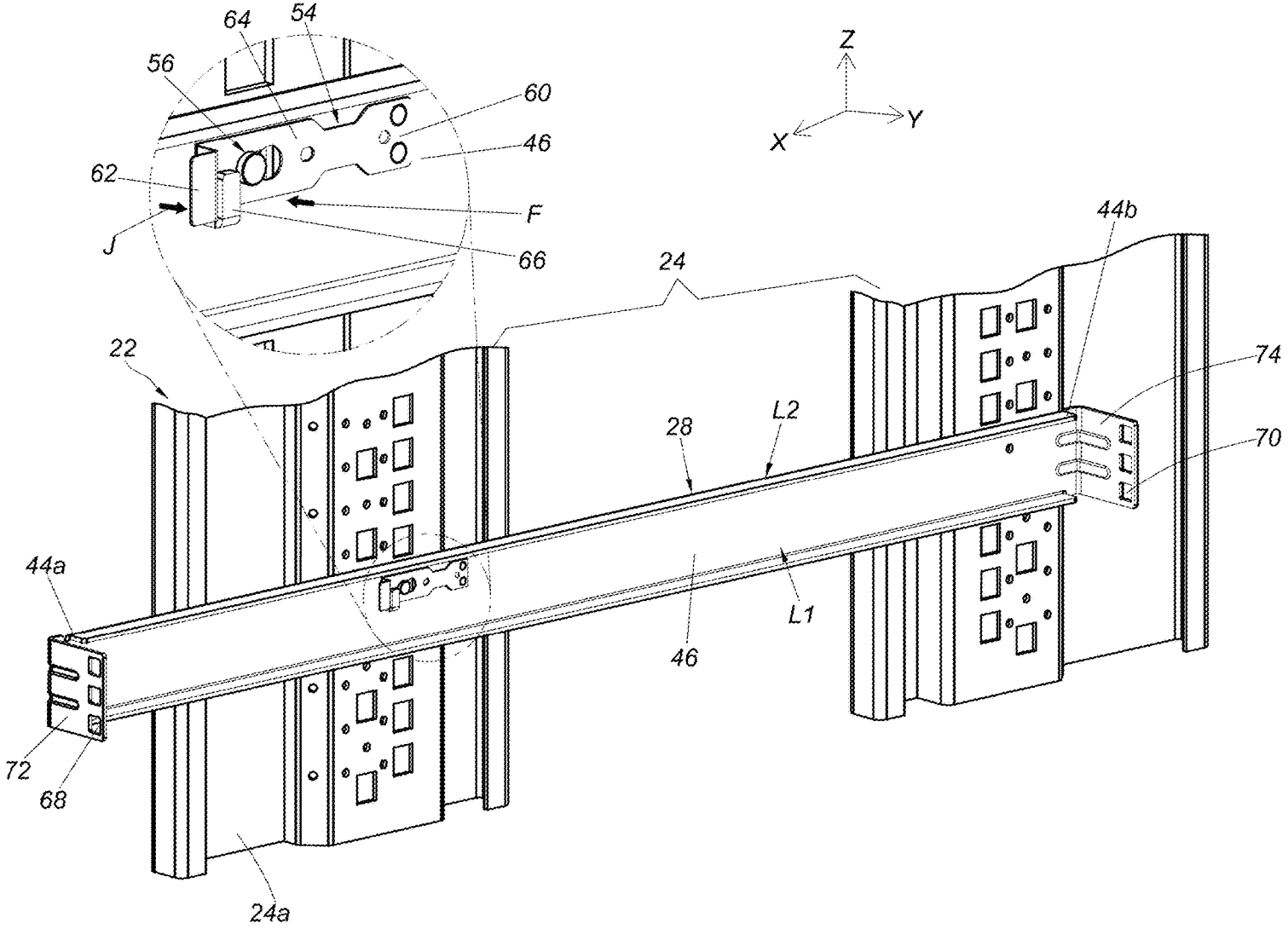
FIG. 3 is a diagram showing a fitting device of the fitting assembly being locked to the rack according to the first embodiment of the present invention.
Figure 4:
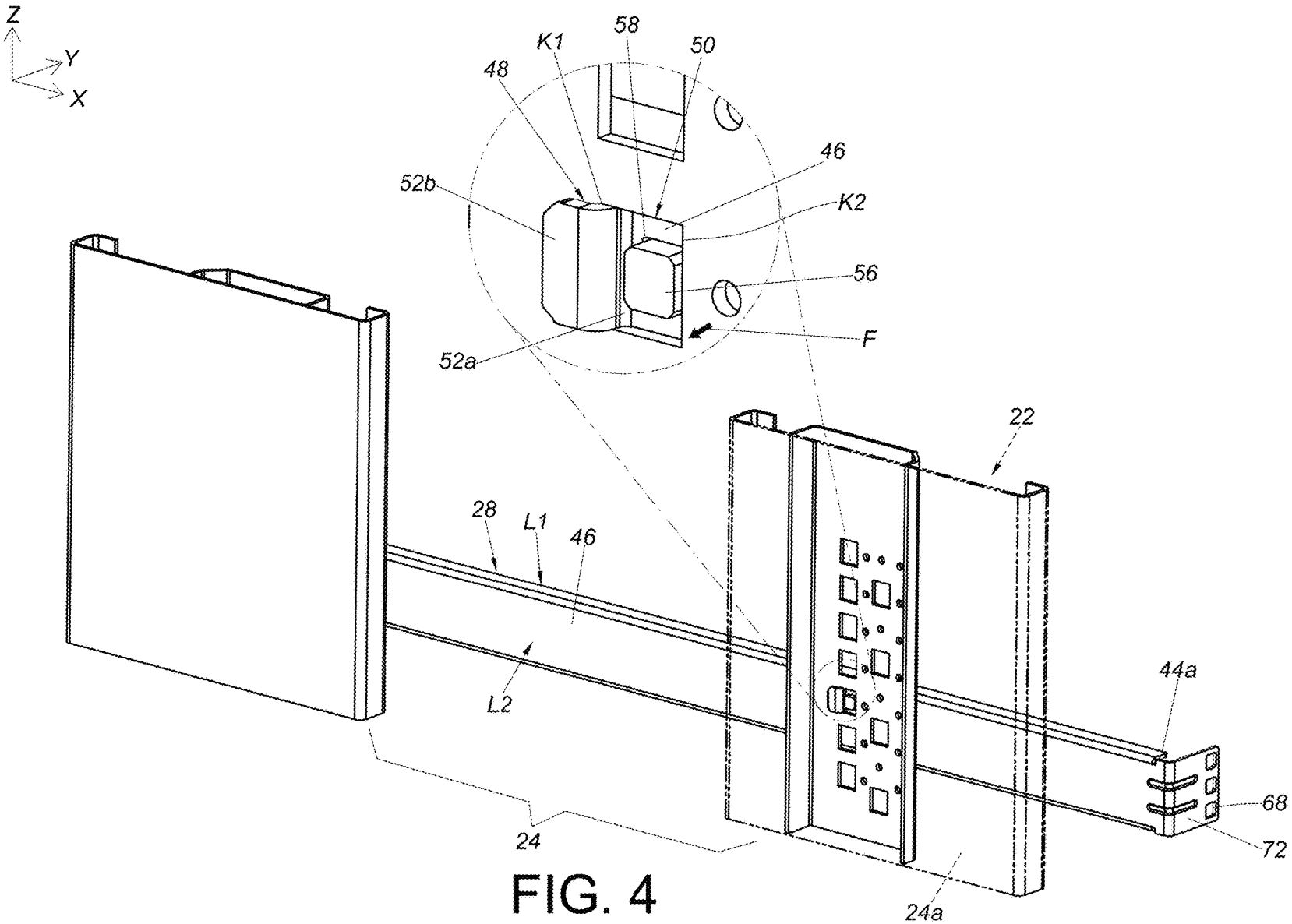
FIG. 4 is a diagram showing the fitting device of the fitting assembly being locked to the rack in another viewing angle according to the first embodiment of the present invention.

As shown in FIG. 3 and FIG. 4, the first fitting device 28 comprises a first end part 44*a*, a second end part 44*b* and a main body part 46 (longitudinal part) connected between the first end part 44*a* and the second end part 44*b*. The main body part 46 is arranged with at least one engaging structure 48 configured to be engaged to at least one post 24*a* (as shown in FIG. 4) of the first side frame 24 of the rack 22. For example, the post 24*a* of the first side frame 24 of the rack 22 comprises a plurality of mounting parts 50. The mounting parts 50 are arranged at intervals along the height direction of the post 24*a* of the rack 22. In the present embodiment, the mounting parts 50 are holes, such as square holes, but the present invention is not limited thereto.

Furthermore, the main body part 46 has an inner side L1 and an outer side L2 opposite to each other. In the present embodiment, the engaging structure 48 is arranged at the outer side L2 of the main body part 46, and the engaging structure 48 is an insertion structure. The engaging structure 48 has a first section 52*a* and a second section 52*b* (as shown in FIG. 4). The first section 52*a* is transversely (laterally) connected to the main body part 46, and the second section 52*b* is bent relative to the first section 52*a*. Preferably, the second section 52*b* is substantially perpendicularly connected to the first section 52*a*. The engaging structure 48 is configured to be inserted into the mounting part 50 (hole) of the rack 22, such that the second section 52*b* of the engaging structure 48 can be further engaged with a first wall K1 (first hole wall) of the mounting part 50.

Preferably, the main body part 46 is further arranged with a locking member 54 and a mounting feature 56 arranged on the locking member 54. The mounting feature 56 is configured to lock the engaging structure 48 to the first side frame 24 of the rack 22, in order to prevent the engaging structure 48 from being disengaged from the first side frame 24 of the rack 22 (as shown in FIG. 4). The locking member 54 is arranged at the inner side L1 of the main body part 46, and the mounting feature 56 is a protruded structure (or extended structure). The mounting feature 56 is configured to pass through an auxiliary hole 58 of the main body part 46 to extend from the inner side L1 to the outer side L2. The locking member 54 is elastic, and the mounting feature 56 is configured to be inserted into the mounting part 50 (hole) of the rack 22 in response to an elastic force F of the locking member 54, such that the mounting feature 56 is configured to abut against a second wall K2 (second hole wall) of the mounting part 50, in order to prevent the engaging structure 48 from being disengaged from the rack 22. In other words, the first fitting device 28 is locked to the first side frame 24 of the rack 22, and unable to be detached from the first side frame 24 of the rack 22 (as shown in FIG. 4).

Preferably, the first wall K1 and the second wall K2 are two opposite walls, such as a rear wall and a front wall of the mounting part 50 (as shown in FIG. 4), but the present invention is not limited thereto.

Preferably, the locking member 54 comprises a connecting section 60, an operating section 62 and an elastic section 64 connected between the connecting section 60 and the operating section 62 (as shown in FIG. 3). The connecting section 60 is connected (such as fixedly connected) to the main body part 46. The elastic section 64 is arranged with the mounting feature 56. The operating section 62 is connected to the elastic section 64. A user can operate the operating section 62 to move the elastic section 64. The operating section 62 is bent relative to the elastic section 64, such that the user can easily pull the operating section 62 to move the elastic section 64.

Preferably, a limiting feature 66 (as shown in FIG. 3) is arranged at the inner side L1 of the main body part 46 configured to prevent the elastic section 64 from being excessively moved when the user applies an operating force J along a direction opposite to a direction of the elastic force F.

Preferably, at least one first connecting feature 68 is arranged adjacent to the first end part 44*a*, and at least one second connecting feature 70 is arranged adjacent to the second end part 44*b*.

Preferably, the first end part 44*a* is arranged with a first connecting base 72 substantially perpendicularly bent relative to the main body part 46. For example, the first connecting base 72 is bent relative to the main body part 46 along a direction away from the first side frame 24 of the rack 22 (that is, a direction toward the second side frame 26 of the rack 22). The first connecting feature 68 is arranged on the first connecting base 72. Similarly, the second end part 44*b* is arranged with a second connecting base 74 substantially perpendicularly bent relative to the main body part 46. For example, the second connecting base 74 is bent relative to the main body part 46 along the direction away from the first side frame 24 of the rack 22 (that is, the direction toward the second side frame 26 of the rack 22). The second connecting feature 70 is arranged on the second connecting base 74.

Preferably, at least one of the first connecting feature 68 and the second connecting feature 70 is a mounting hole. In the present embodiment, the first connecting feature 68 and the second connecting feature 70 are both mounting holes. The mounting holes can be square holes, round holes or screw holes, but the present invention is not limited thereto.

Figure 5:
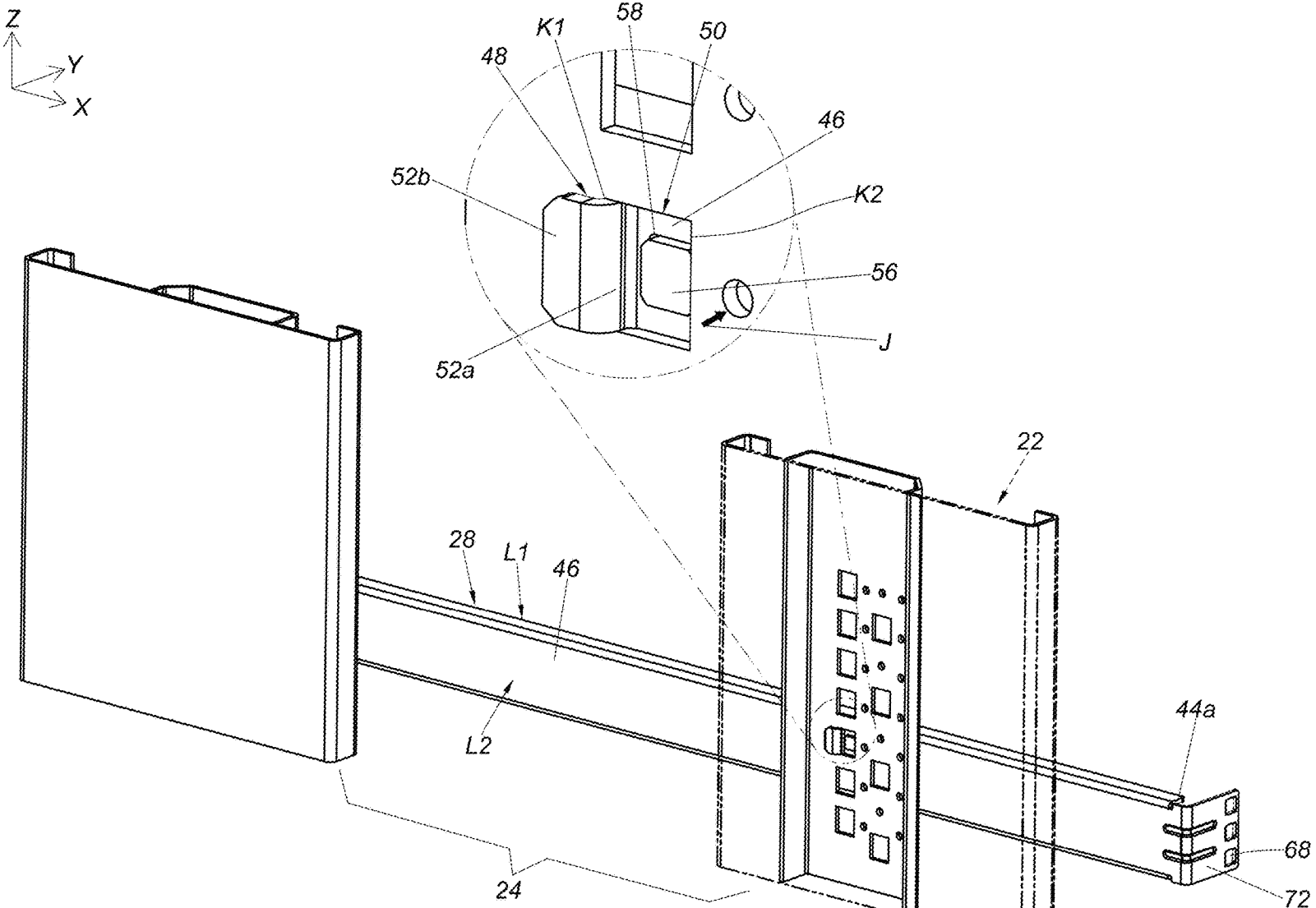
FIG. 5 is a diagram showing the fitting device no longer being locked to the rack according to the first embodiment of the present invention.

As shown in FIG. 5, when the user is going to detach the first fitting device 28 from the first side frame 24 of the rack 22, the user can apply the operating force J to the operating section 62 in order to overcome the elastic force F of the locking member 54, so as to move the elastic section 64 inward, such that the mounting feature 56 is moved away from the second wall K2 (second hole wall) of the mounting part 50 (for example, the mounting feature 56 is laterally offset from the second wall K2 of the mounting part 50). As such, the engaging structure 48 is able to be detached from the first wall K1 of the mounting part 50 of the rack 22. In other words, the first fitting device 28 can be detached from the first side frame 24 of the rack 22 at this time.

Moreover, the manner of detaching the second fitting device 30 from the second side frame 26 is substantially identical to the manner of detaching the first fitting device 28 from the first side frame 24, thus no further illustration is provided for simplicity.

Figure 6:
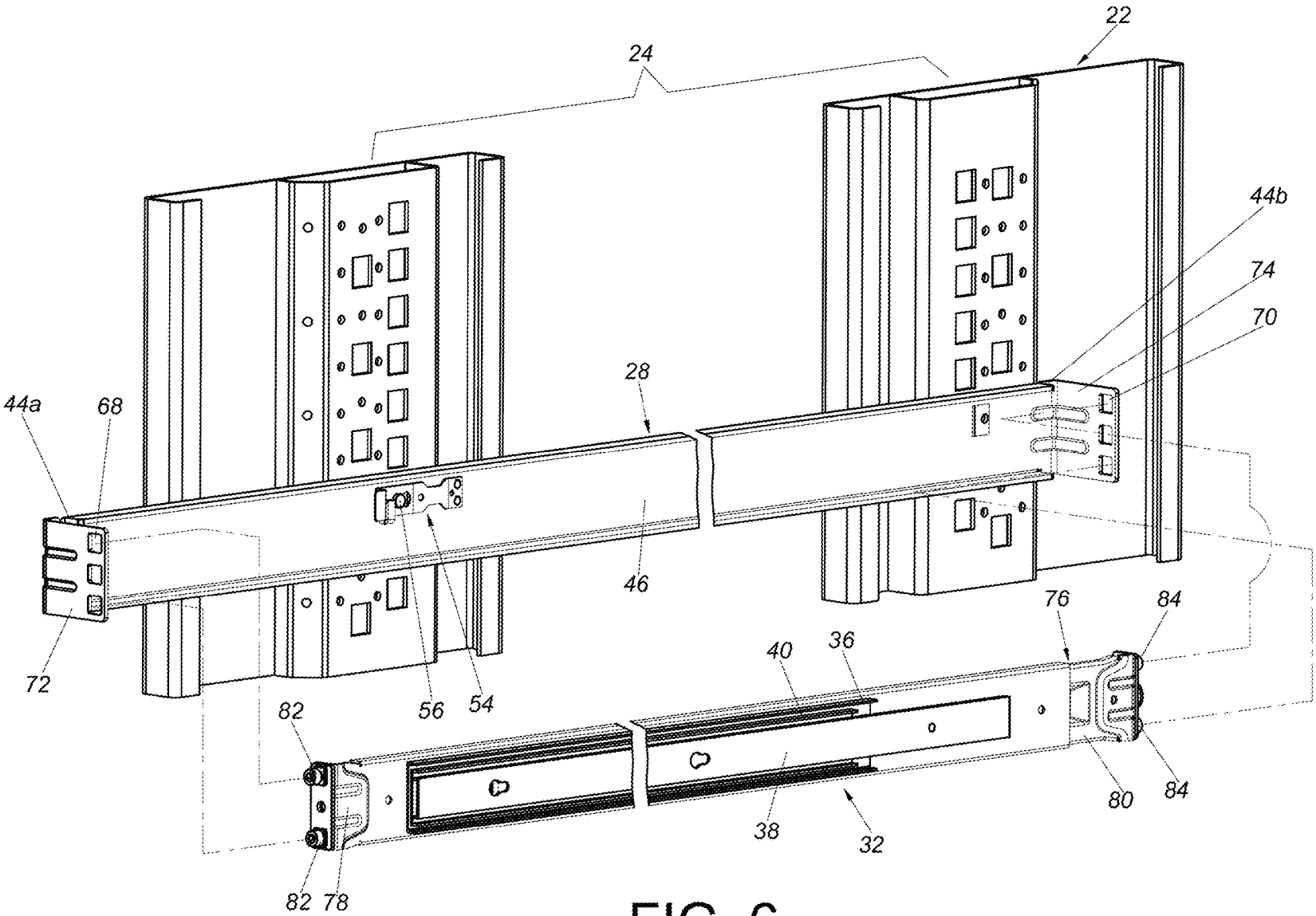
FIG. 6 is a diagram showing the fitting device on the rack and a slide rail assembly according to the first embodiment of the present invention.
Figure 7:
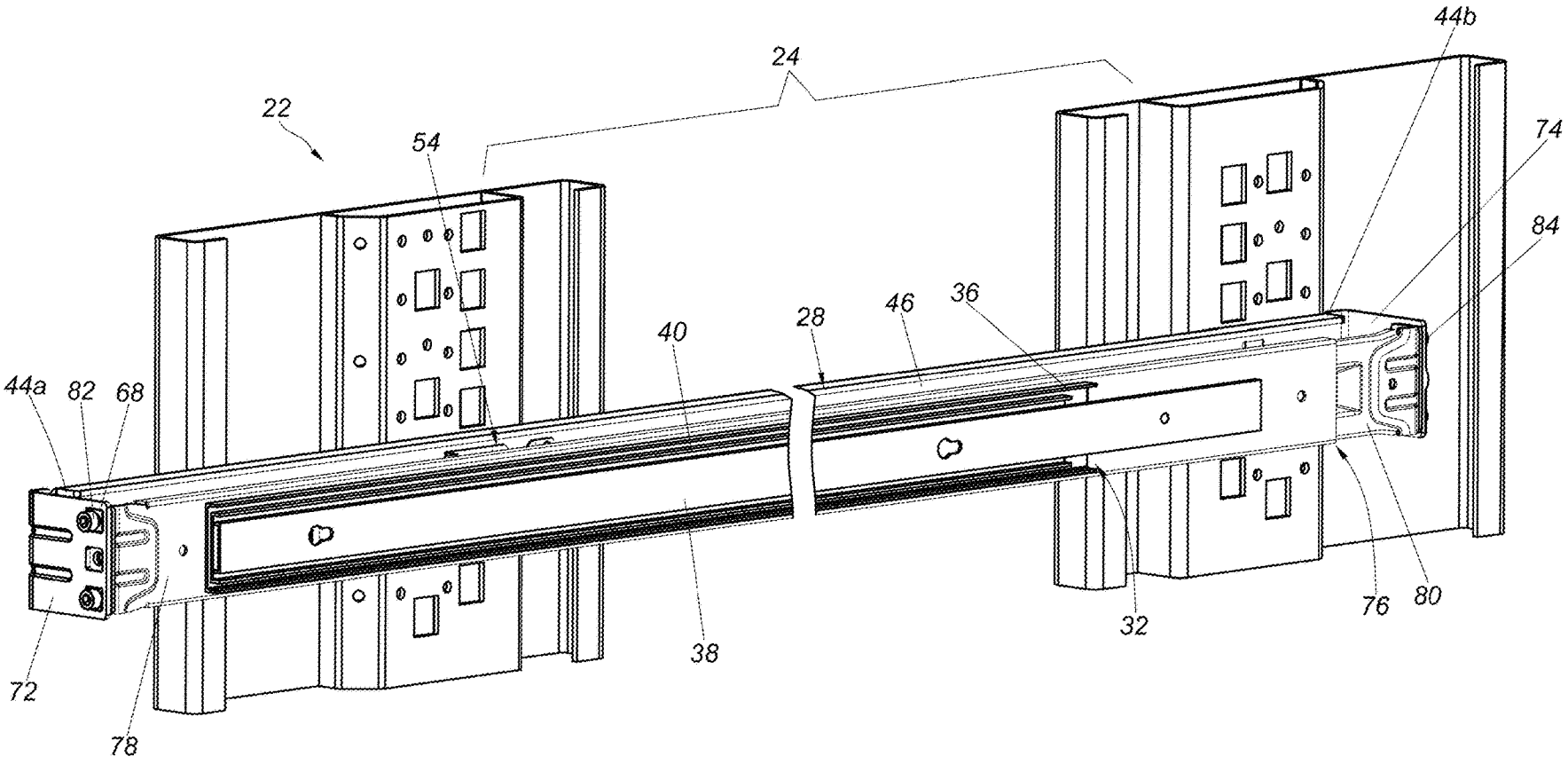
FIG. 7 is a diagram showing the slide rail assembly being mounted to the rack through the fitting device according to the first embodiment of the present invention.

As shown in FIG. 6 and FIG. 7, the first fitting device 28 is mounted to the rack 22 (the first side frame 24 of the rack 22), and the first slide rail assembly 32 is configured to be mounted between the first connecting feature 68 and the second connecting feature 70 of the first fitting device 28. Specifically, the first rail 36 of the first slide rail assembly 32 is arranged with a bracket mechanism 76, and the bracket mechanism 76 comprises a first bracket 78 and a second bracket 80 longitudinally movable relative to each other. The first bracket 78 is arranged with at least one first connecting part 82 configured to be connected to the first connecting feature 68 of the first fitting device 28. The second bracket 80 is arranged with at least one second connecting part 84 configured to be connected to the second connecting feature 70 of the first fitting device 28.

Moreover, the manner of mounting the second slide rail assembly 34 to the second fitting device 30 is substantially identical to the manner of mounting the first slide rail assembly 32 to the first fitting device 28, thus no further illustration is provided for simplicity.

Figure 8:
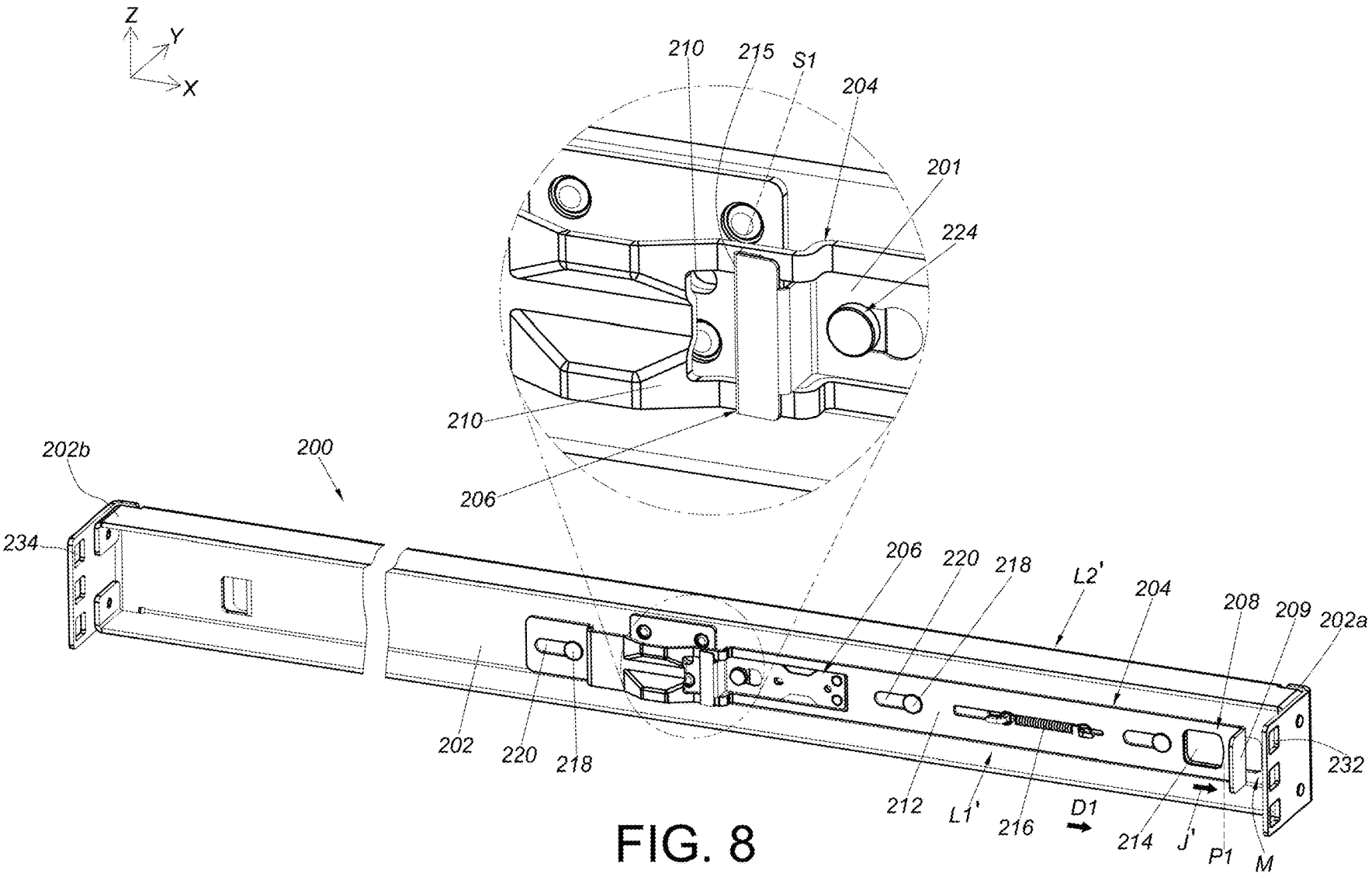
FIG. 8 is a diagram showing a fitting device according to a second embodiment of the present invention.

FIG. 8 shows a second fitting device 200 (structural configuration of the first fitting device is substantially identical to or symmetric to structural configuration of the second fitting device 200) according to a second embodiment of the present invention. Different from the second fitting device 30 (or the first fitting device 28) of the first embodiment, a main body part 202 of the second fitting device 200 is further arranged with an operating member 204, and the operating member 204 is configured to drive a locking member 206 to move.

Preferably, the main body part 202 has a first end part 202*a* and a second end part 202*b*, such as a front end part and a rear end part, and the operating member 204 comprises an operating part 208 adjacent to the first end part 202*a*, such that it is convenient for a user standing in front of the second fitting device 200 (or the first fitting device) to operate the operating part 208 to drive the locking member 206 to move for unlocking the second fitting device 200. Preferably, the operating part 208 further has a bent section 209 to allow the user to easily apply an operating force J' from an inner side L1' of the main body part 202 to pull the operating member 204 to drive the locking member 206 to move.

Figure 11:
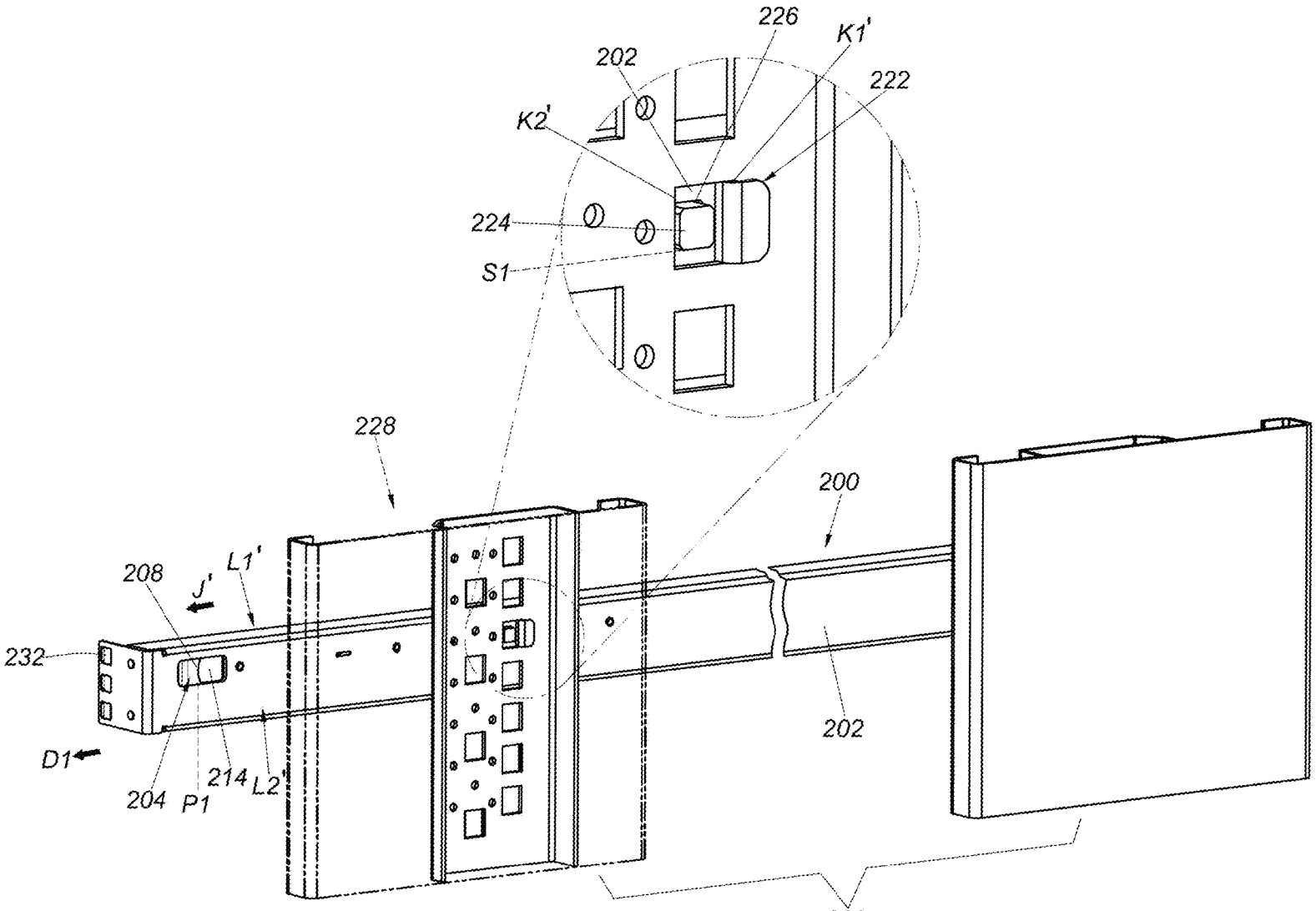
FIG. 11 is a diagram showing the fitting device being locked to the rack in another viewing angle according to the second embodiment of the present invention.
Figure 12:
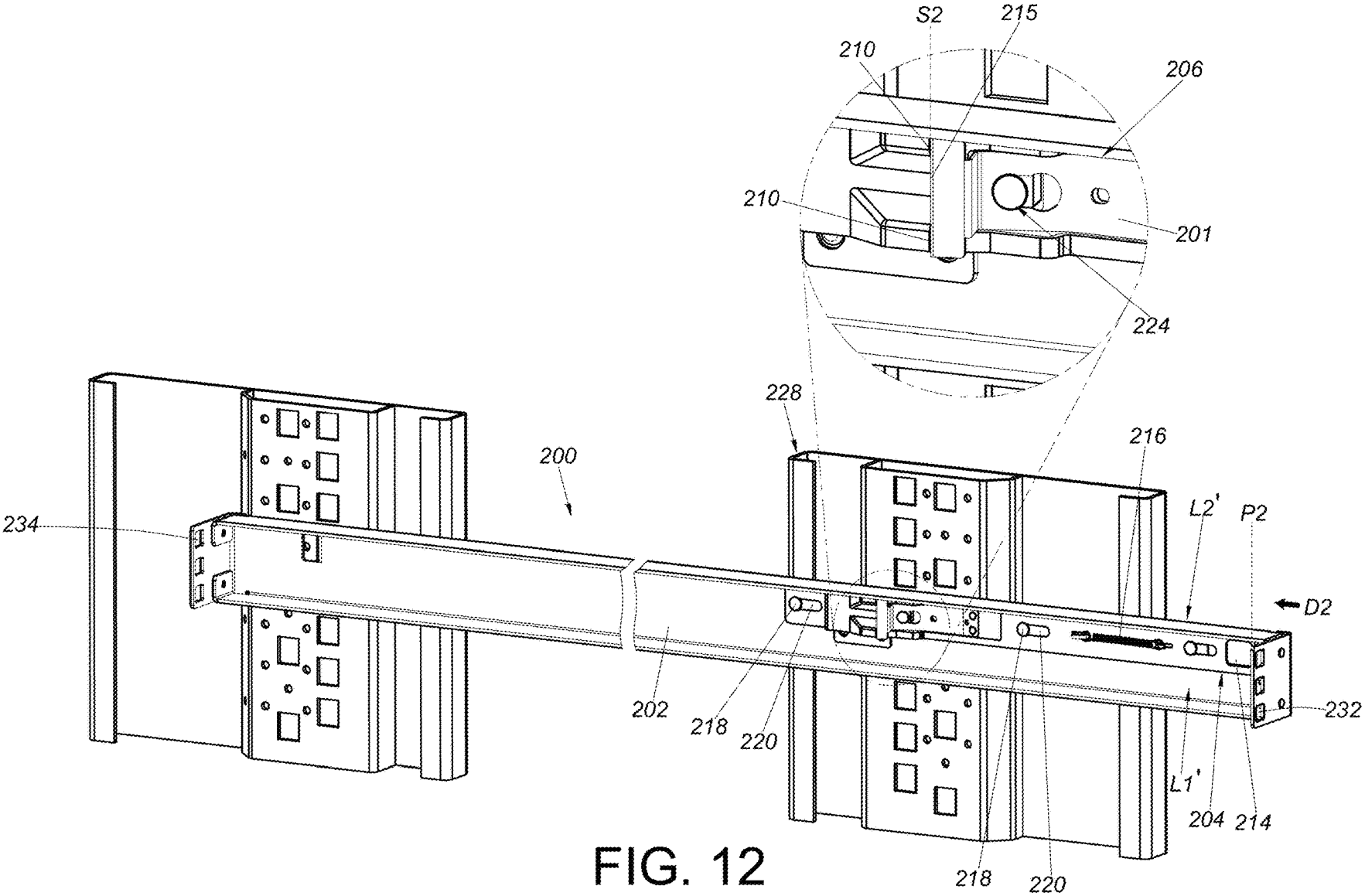
FIG. 12 is a diagram showing the fitting device no longer being locked to the rack according to the second embodiment of the present invention.
Figure 13:
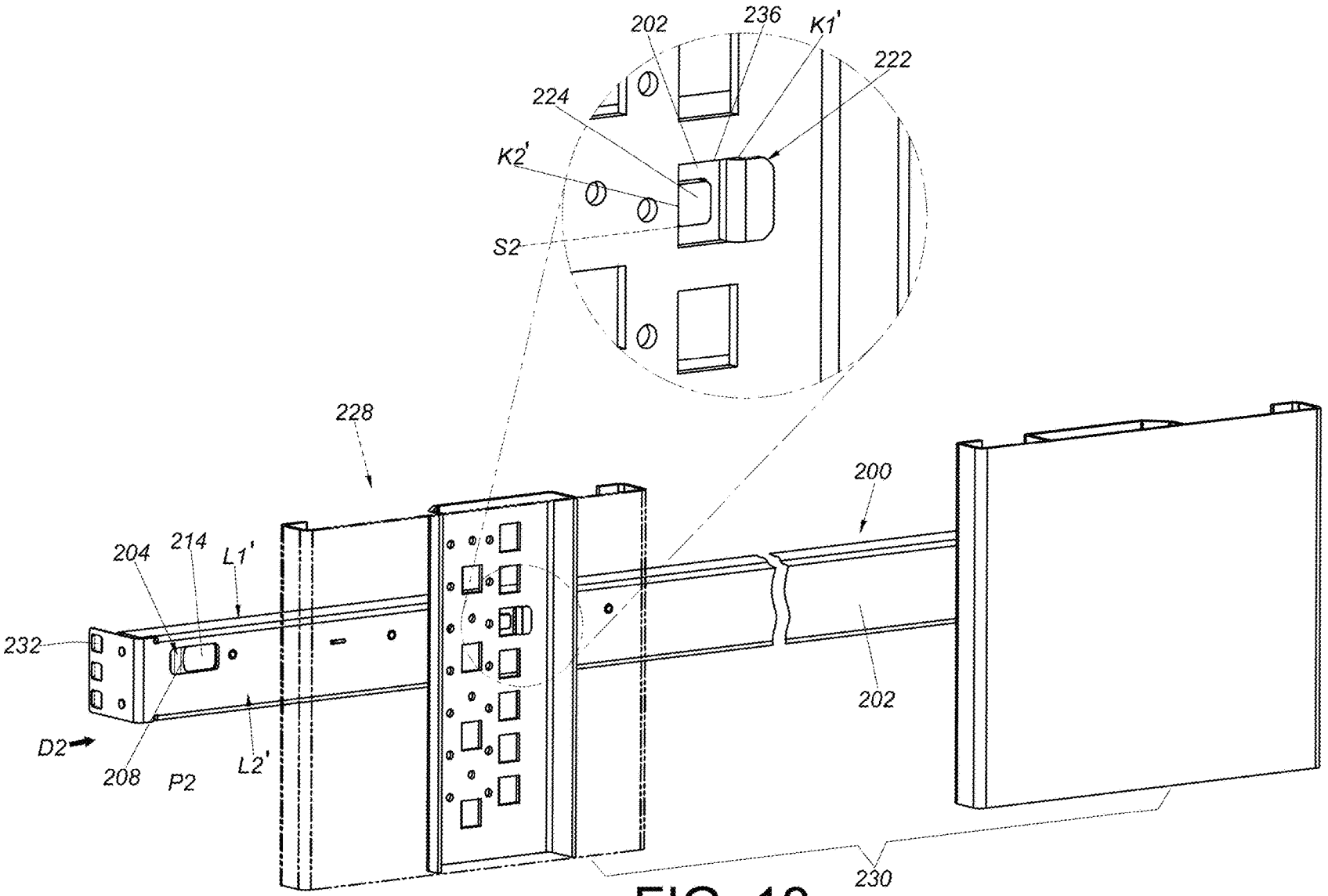
FIG. 13 is a diagram showing the fitting device no longer being locked to the rack in another viewing angle according to the second embodiment of the present invention.

Preferably, the main body part 202 is formed with a predetermined space M (such as a through hole or a notch) communicating the inner side L1' and an outer side L2' of the main body part 202, and the operating member 204 further comprises at least one driving part 210 (for example, the driving part 210 has an inclined surface or an arc surface, but the present invention is not limited thereto) and an extension part 212 connected between the driving part 210 and the operating part 208. The operating part 204 has a predetermined hole 214 adjacent to the predetermined space M of the main body part 202 (for example, the predetermined hole 214 corresponds to the predetermined space M), such that the user can easily apply the operating force J' to the operating part 208 from the inner side L1' or the outer side L2' of the main body part 202 to operate the operating member 204 to move from a first predetermined position P1 (as shown in FIG. 8 and FIG. 11) to a second predetermined position P2 (as shown in FIG. 12 and FIG. 13) along a first predetermined direction D1, so as to drive an elastic section 201 of the locking member 206 to move (such as deflect) inward to switch from a first state S1 (such as a locking state as shown in FIG. 8 and FIG. 11) to a second state S2 (such as an unlocking state as shown in FIG. 12 and FIG. 13), such that a mounting feature 224 on the elastic section 201 of the locking member 206 is moved inward to be away from a second wall K2' of a mounting part 236 of a rack 228 (as shown in FIG. 12 and FIG. 13).

Preferably, the second fitting device 200 further comprises a return elastic member 216. The operating member 204 is configured to be held at the first predetermined position P1 in response to a return elastic force of the return elastic member 216.

Preferably, the operating member 204 is longitudinally movable relative to the main body part 202 within a limited range defined by a plurality of pairs of a first limiting structure 218 and a second limiting structure 220. The first limiting structure 218 and the second limiting structure 220 are a combination of a protruded part (such as a connecting pin or a connecting bolt) and an elongated hole. For example, the protruded part is configured to pass through a portion of the elongated hole.

Figure 9:
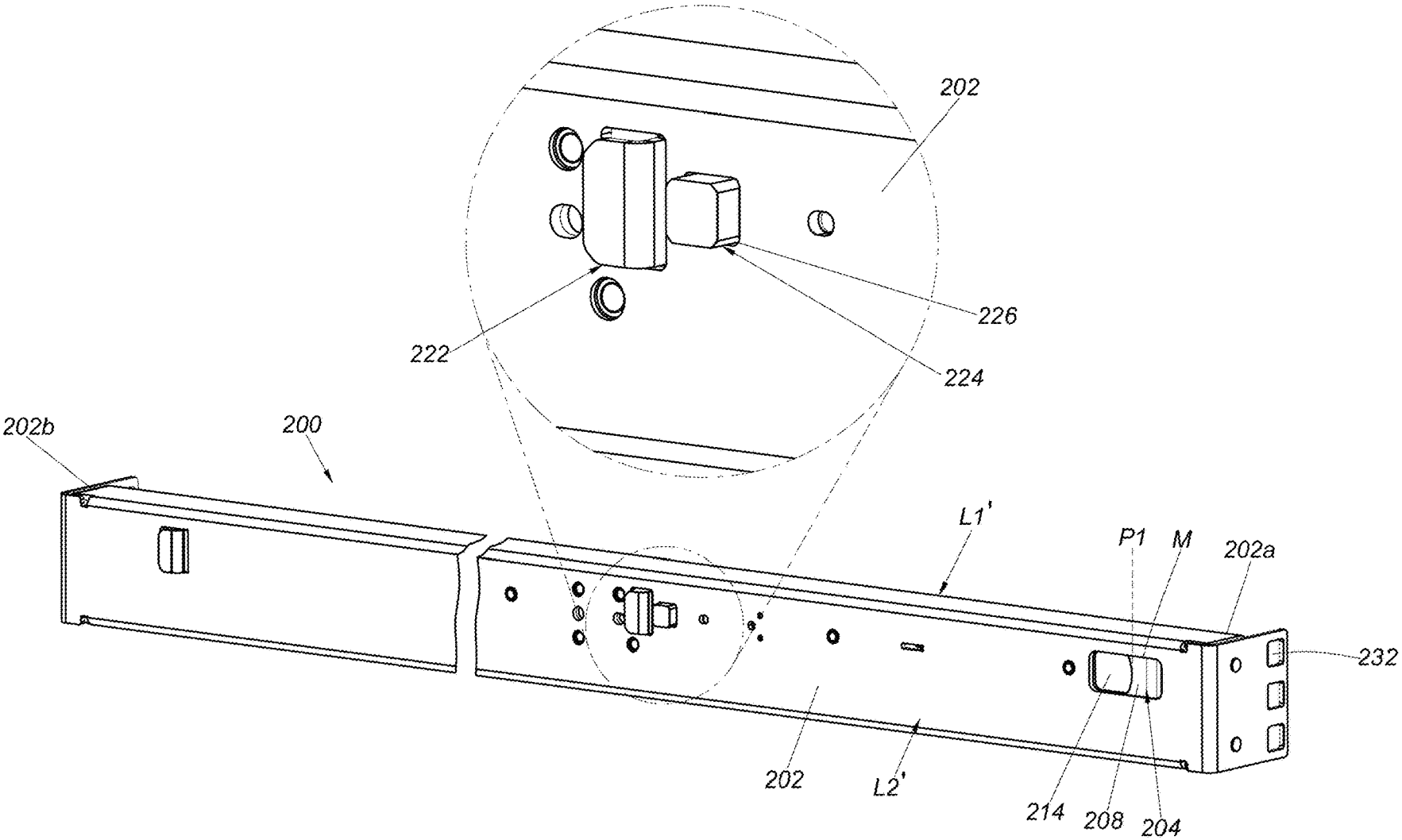
FIG. 9 is a diagram showing the fitting device in another viewing angle according to the second embodiment of the present invention.

As shown in FIG. 9, similar to the first embodiment, the outer side L2' of the main body part 202 is arranged with an engaging structure 222, and the mounting feature 224 on the locking member 206 is configured to pass through an auxiliary hole 226 of the main body part 202 to extend from the inner side L1' to the outer side L2'.

Figure 10:
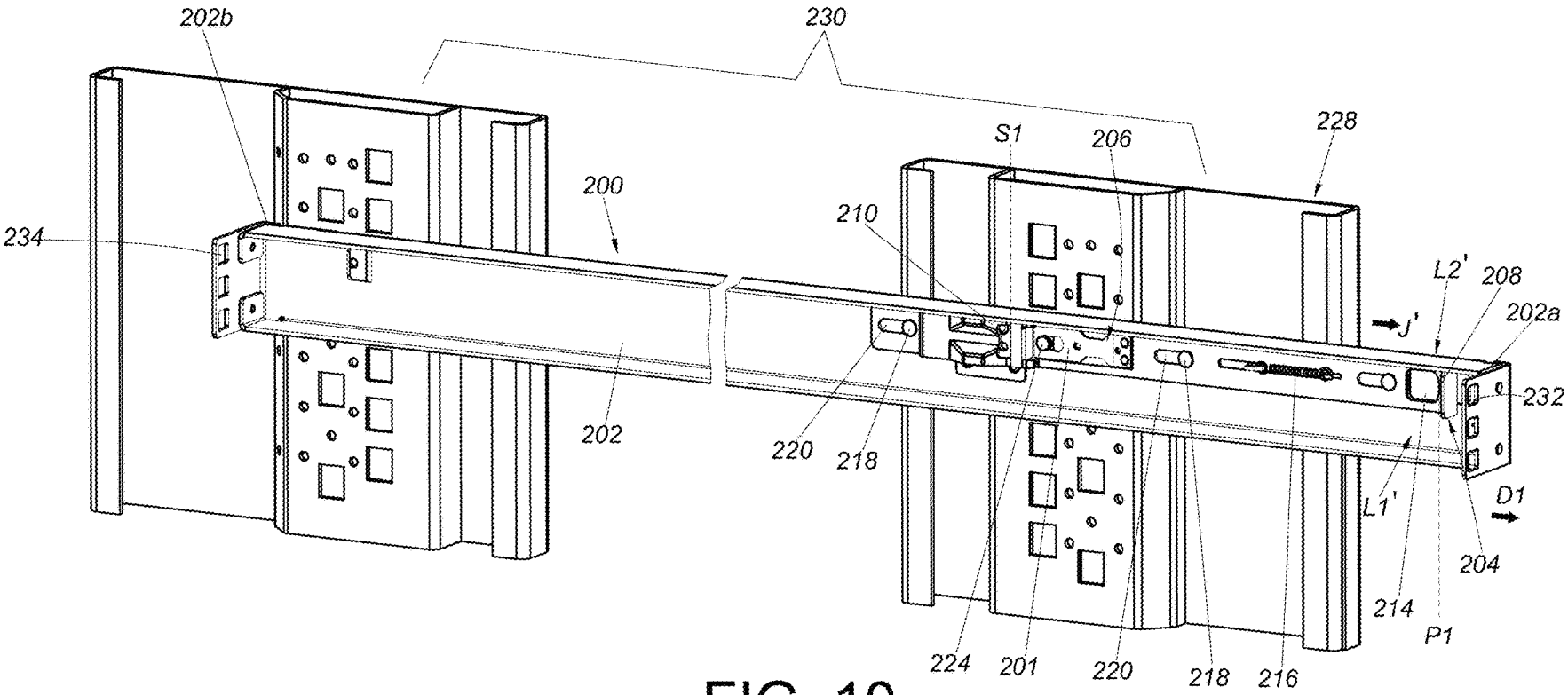
FIG. 10 is a diagram showing the fitting device being locked to the rack according to the second embodiment of the present invention.

As shown in FIG. 10 and FIG. 11, the second fitting device 200 is mounted to the second side frame 230 of the rack 228 (such mounting configuration has been disclosed in the first embodiment, no further illustration is provided for simplicity).

As shown in FIG. 10 to FIG. 13, the second fitting device 200 is mounted to the second side frame 230 of the rack 228 without mounting a second slide rail assembly between a first connecting feature 232 and a second connecting feature 234 of the second fitting device 200. In the second embodiment, the user can easily operate the operating member 204 to drive the locking member 206 (the elastic section 201 of the locking member 206) to move.

Furthermore, when the user is going to detach the second fitting device 200 from the second side frame 230 of the rack 228, the user can apply the operating force J' (as shown in FIG. 10 and FIG. 11) to the operating member 204 (the operating part 208 of the operating member 204) from the inner side L1' or the outer side L2' of the main body part 202 in order to operate the operating member 204 to move from the first predetermined position P1 (as shown in FIG. 10 and FIG. 11) to the second predetermined position P2 (as shown in FIG. 12 and FIG. 13), such that the driving part 210 of the operating member 204 is configured to contact a corresponding part 215 of the locking member 206 (as shown in FIG. 12), so as to drive the elastic section 201 of the locking member 206 to move inward to switch from the first state S1 (shown in FIG. 10 and FIG. 11) to the second state S2 (as shown in FIG. 12 and FIG. 13). As such, the mounting feature 224 is moved toward the inner side L1' of the main body part 202 to be away from the second wall K2' (second hole wall) of the mounting part 236 (hole) of the rack 228 (for example, the mounting feature 224 is laterally offset from the second wall K2' of the mounting part 236 as shown in FIG. 13). Therefore, the engaging structure 222 is able to be detached from the first wall K1' (first hole wall) of the mounting part 236 of the rack 228. In other words, the second fitting device 200 can be detached from the second side frame 230 of the rack 228 at this time (as shown in FIG. 13).

In addition, once the user stops applying the operating force J' to the operating member 204, the return elastic force of the return elastic member 216 is configured to drive the operating member 204 to move from the second predetermined position P2 (as shown in FIG. 12 and FIG. 13) back to the first predetermined position P1 (as shown in FIG. 10 and FIG. 11) along a second predetermined direction D2 opposite to the first predetermined direction D1, and the locking member 206 is moved to switch from the second state S2 to the first state S1.

Figure 14:
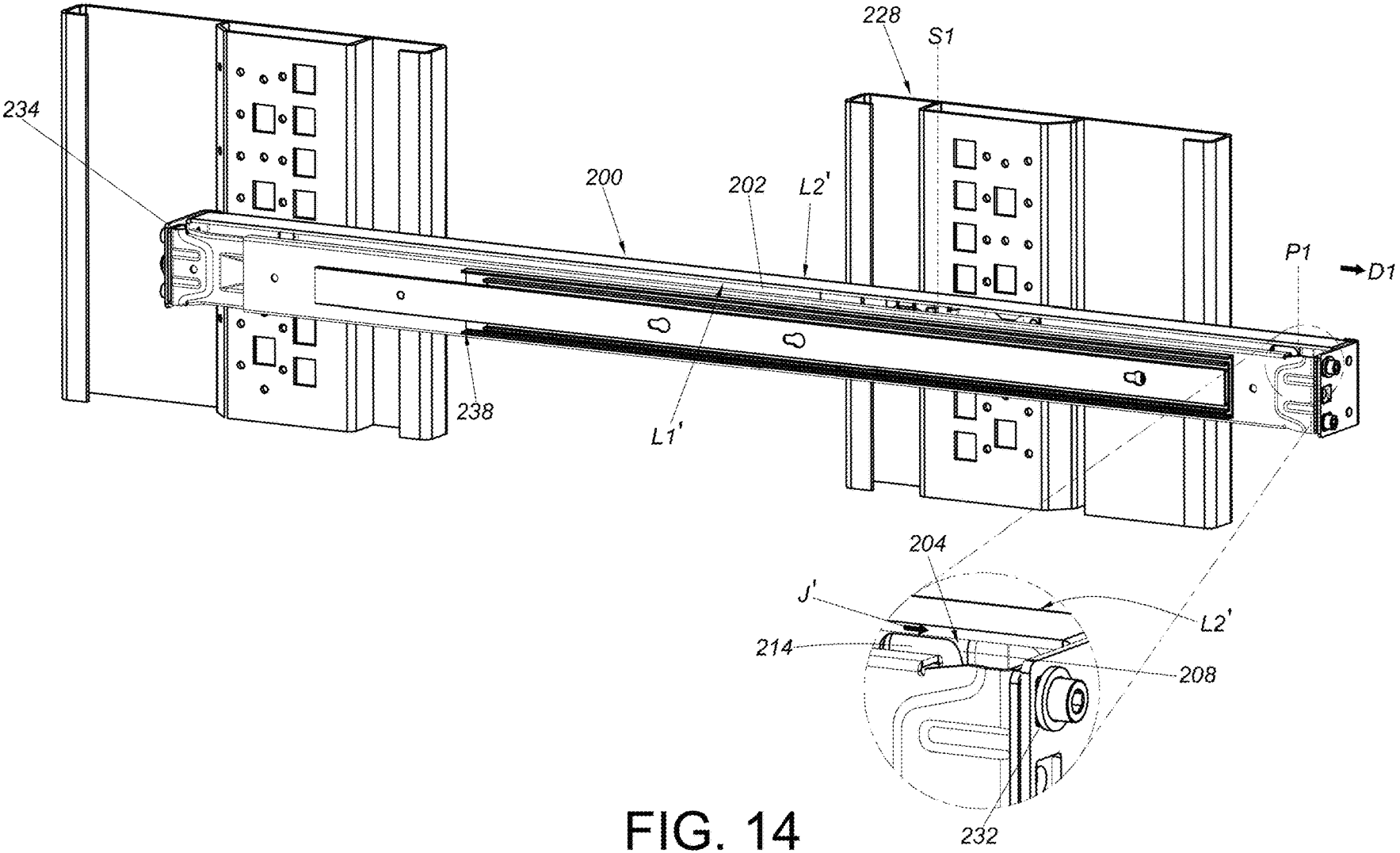
FIG. 14 is a diagram showing a slide rail assembly being mounted to the rack through the fitting device according to the second embodiment of the present invention.

As shown in FIG. 14, when a second slide rail assembly 238 is mounted between the first connecting feature 232 and the second connecting feature 234 of the second fitting device 200, the second first slide rail assembly 238 is configured to cover most of the inner side L1' of the main body part 202 of the second fitting device 200. Therefore, the user cannot easily operate the operating member 204 (the operating part 208 of the operating member 204) from the inner side L1' of the main body part 202. At this time, the user's finger can insert into the predetermined hole 214 to extend from the outer side L2' of the main body part 202 to the inner side L1' of the main body part 202 to apply the operating force J' to the operating part 208, in order to operate the operating member 204 to move from the first predetermined position P1 to the second predetermined position P2 along the first predetermined direction D1, such that the mounting feature 224 is moved toward the inner side L1' to allow the engaging structure 222 to be detached from the rack 228, so as to detach the second fitting device 200 from the rack 228 (such configuration has been disclosed above, no further illustration is provided for simplicity).

Therefore, the fitting assembly according to the embodiments of the present invention has the following technical features:

1. The fitting device (28, 200) can work as an adapter to mount the slide rail assembly (32, 238) to the rack (22, 228) within a space having the second width W2 smaller than the first width W1, in order to meet special requirements of the user or environment.

2. The fitting device (28, 200) can be quickly mounted to or detached from the rack (22, 228) in a tool-free manner through the locking member (54, 206).

3. In the first embodiment, the user can directly operate the locking member 54 to move the mounting feature 56 in order to unlock the engaging structure 48 from the rack 22. In the second embodiment, the user can operate the operating member 204 to drive the locking member 206 to move the mounting feature 224 in order to unlock the engaging structure 222 from the rack 228. Moreover, the operating part 208 of the operating member 204 is adjacent to the first end part 202*a* (such as the front end part, but the present invention is not limited thereto) of the second fitting device 200. As such, it is convenient for the user standing in front of the second fitting device 200 or the rack 228 to operate the operating part 208 to drive the locking member 206 to move for unlocking the second fitting device 200.

4. In the second embodiment, when the second slide rail assembly is not mounted between the first connecting feature 232 and the second connecting feature 234 of the second fitting device 200, the user can operate the operating member 204 from the inner side L1' or the outer side L2' of the main body part 202 of the second fitting device 200 to drive the locking member 206 to move, in order to unlock the second fitting device 200 from the rack 228. When the second slide rail assembly 238 is mounted between the first connecting feature 232 and the second connecting feature 234 of the second fitting device 200, the user can operate the operating member 204 from the outer side L2' of the main body part 202 of the second fitting device 200 to drive the locking member 206 to move, in order to unlock the second fitting device 200 from the rack 228. According to such configuration, maintenance of the slide rail, the carried object (and/or related equipment) on the slide rail is more convenient and efficient.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A fitting assembly, configured to be mounted to a rack comprising a first side frame and a second side frame, a first width being defined between the first side frame and the second side frame, the fitting assembly comprising:

a first fitting device configured to be mounted to the first side frame of the rack; and a second fitting device configured to be mounted to the second side frame of the rack;

wherein a second width defined between the first fitting device and the second fitting device is smaller than the first width;

wherein the first fitting device and the second fitting device are configured to mount a first slide rail assembly and a second slide rail assembly to the first side frame and the second side frame respectively;

wherein the first fitting device comprises a first end part, a second end part and a main body part connected between the first end part and the second end part, the main body part is arranged with an engaging structure configured to be engaged to the first side frame of the rack;

wherein structural configuration of the first fitting device is substantially identical to or symmetric to structural configuration of the second fitting device;

wherein the main body part is further arranged with a locking member and a mounting feature arranged on the locking member, the mounting feature is configured to lock the engaging structure to the first side frame of the rack, in order to prevent the engaging structure from being disengaged from the first side frame of the rack;

wherein the main body part is further arranged with an operating member movable relative to the main body part and the locking member along a longitudinal direction of the first fitting device;

wherein the operating member comprises a driving part having an inclined surface or an arc surface, wherein when the operating member is operated to move from a first predetermined position to a second predetermined position along the longitudinal direction of the first fitting device, the driving part is configured to contact a corresponding part of the locking member to drive the locking member to move the mounting feature in order to unlock the engaging structure from the first side frame of the rack.

2. The fitting assembly of claim 1, wherein the operating member comprises an operating part adjacent to the first end part.

3. The fitting assembly of claim 1, wherein the main body part has an inner side and an outer side, the locking member is arranged at the inner side of the main body part, and the mounting feature is extended from the inner side to the outer side.

4. The fitting assembly of claim 1, wherein a first connecting feature is arranged adjacent to the first end part, and a second connecting feature is arranged adjacent to the second end part; wherein the first slide rail assembly is configured to be mounted between the first connecting feature and the second connecting feature of the first fitting device, the second slide rail assembly is configured to be mounted between a first connecting feature and a second connecting feature of the second fitting device.

5. The fitting assembly of claim 4, wherein the first end part is arranged with a first connecting base substantially perpendicularly bent relative to the main body part, the first connecting feature is arranged on the first connecting base; wherein the second end part is arranged with a second connecting base substantially perpendicularly bent relative to the main body part, the second connecting feature is arranged on the second connecting base.

6. A fitting device, configured to be mounted to a rack, the fitting device comprising:

a first end part;

a second end part;

a main body part connected between the first end part and the second end part, wherein the main body part is arranged with an engaging structure configured to be engaged to the rack;

a locking member arranged on the main body part;

a mounting feature arranged on the locking member and configured to lock the engaging structure to the rack, in order to prevent the engaging structure from being disengaged from the rack; and an operating member movable relative to the main body part and the locking member along a longitudinal direction of the fitting device, wherein the operating member comprises a driving part having an inclined surface or an arc surface, wherein when the operating member is operated to move from a first predetermined position to a second predetermined position along the longitudinal direction of the fitting device, the driving part is configured to contact a corresponding part of the locking member to drive the locking member to move the mounting feature in order to unlock the engaging structure from the rack.

7. The fitting device of claim 6, wherein the operating member is arranged on the main body part, and the operating member comprises an operating part adjacent to the first end part.

8. The fitting device of claim 6, wherein the main body part has an inner side and an outer side, the locking member is arranged at the inner side of the main body part, and the mounting feature is extended from the inner side to the outer side.

9. The fitting device of claim 8, wherein the main body part is formed with a predetermined space communicated with the inner side and the outer side, the operating member has a predetermined hole adjacent to the predetermined space of the main body part.

10. The fitting device of claim 6, further comprising a return elastic member configured to provide a return elastic force to the operating member.

11. The fitting device of claim 6, wherein a first connecting feature is arranged adjacent to the first end part, and a second connecting feature is arranged adjacent to the second end part; wherein a slide rail assembly is configured to be mounted between the first connecting feature and the second connecting feature; wherein the first end part is arranged with a first connecting base substantially perpendicularly bent relative to the main body part, the first connecting feature is arranged on the first connecting base; wherein the second end part is arranged with a second connecting base substantially perpendicularly bent relative to the main body part, the second connecting feature is arranged on the second connecting base.

12. A fitting device, configured to be mounted to a rack, the fitting device comprising:

a front end part;

a rear end part;

a main body part connected between the front end part and the rear end part;

a locking member arranged on the main body part;

a mounting feature arranged on the locking member and configured to lock the fitting device to the rack; and an operating member movable relative to the main body part and the locking member along a longitudinal direction of the fitting device, wherein the operating member comprises a driving part having an inclined surface or an arc surface, wherein when the operating member is operated to move from a first predetermined position to a second predetermined position along the longitudinal direction of the fitting device, the driving part is configured to contact a corresponding part of the locking member to drive the locking member to move the mounting feature in order to unlock the fitting device from the rack, wherein the operating member comprises an operating part adjacent to one of the front end part and the rear end part.

* * * * *